US005252893A

United States Patent [19]

Chacham et al.

[11] Patent Number: 5,252,893

[45] Date of Patent: Oct. 12, 1993

[54] LIGHT FLASHER APPARATUS

[75] Inventors: Chaim Chacham, Rishon Lezion; Roni Friedman, Petach Tikva; Uri Amir, Givat Savyon, all of Israel

[73] Assignee: Interplex Solar Corporation, Flushing, N.Y.

[21] Appl. No.: 770,558

[22] Filed: Oct. 3, 1991

[30] Foreign Application Priority Data

Jul. 8, 1991 [IL] Israel ..... 098755

[51] Int. Cl.[5] ..... H05B 37/00

[52] U.S. Cl. ..... 315/200 A; 315/155; 315/175; 315/209 R; 315/86; 362/153.1; 362/183; 340/908.1

[58] Field of Search ..... 315/175, 171, 200 A, 315/209 R, 155, 159, 86; 307/48, 66, 46; 362/153.1, 151, 183, 800; 340/908, 908.1, 331

[56] References Cited

U.S. PATENT DOCUMENTS

| | | | |
|---|---|---|---|
| 3,965,388 | 6/1976 | Brisk | 315/155 |
| 4,200,904 | 4/1980 | Doan | 362/183 |
| 4,319,310 | 3/1982 | Kignsley | 362/183 |
| 4,384,317 | 5/1983 | Stackpole | 362/183 |
| 4,486,820 | 12/1984 | Baba et al. | 362/183 |
| 4,563,727 | 1/1986 | Curiel | 362/183 |
| 4,751,622 | 6/1988 | Williams | 362/183 |
| 4,759,735 | 7/1988 | Pagnol et al. | 441/16 |
| 4,764,853 | 8/1988 | Thomas et al. | 362/183 |
| 4,772,990 | 9/1988 | Linehan et al. | 362/183 |
| 4,884,917 | 11/1989 | Williams | 320/2 |
| 4,929,942 | 5/1990 | Niimi | 315/159 |
| 4,989,124 | 1/1991 | Shappell | 362/183 |
| 5,013,972 | 5/1991 | Malkieli et al. | 315/209 R |

OTHER PUBLICATIONS

*Solar Lights* p. 25, Catalog title and date unknown.

Led Flasher/Oscillator, Semiconductor Reference Guide Tandy Corporation, 1990, p. 53.

*Primary Examiner*—Robert J. Pascal

*Assistant Examiner*—R. A. Ratliff

*Attorney, Agent, or Firm*—Darby & Darby

[57] ABSTRACT

A rechargeable electronic flasher powered by a solar panel and solar-rechargeable battery. The circuit has particular application as an auxiliary safety measure for use in roadway cats' eyes, or in memorial symbols for mounting on, or near, grave stones and the like so as to provide substantially perpetual illumination. Minimum charging time is necessary, while operation on battery power is extended to many days, rather than hours. The circuit can also be set to flash at a rate above the frequency the eye can distinguish, creating a substantially constant light.

19 Claims, 3 Drawing Sheets

LIGHT FLASHER APPARATUS

FIELD OF THE INVENTION

This invention relates to an electrical flasher circuit and, in particular, to a miniature electrical flasher circuit suitable for use in standard cats' eyes and in memorial symbols.

BACKGROUND OF THE INVENTION

Cats' eyes including self-illuminating LED flashers are known for mounting on the boundaries between adjacent traffic lanes or on sidewalks so as to reflect a vehicle's headlamps and thereby indicate to a driver the lane boundary.

Also known are cats' eyes including an electrical flasher circuit operable from a small rechargeable battery which is charged via a solar panel fixed to a housing of the cat's eye, so as to recharge the battery during daylight hours. The LED flashers improve the visibility of the cat's eye, thereby increasing road safety.

A primary requirement of cats' eyes of the kind described having integral LED flasher circuits therein is their compatibility with existing, conventional cats' eyes which do not include the enhancement of flashing LEDs. Conventional cats' eyes are designed to be mounted in the road surface so as to protrude therefrom only a minimal distance, their protruding edges being rounded so that, in the event of a motor vehicle mounting the cat's eye, no damage will be done to the tires of the vehicle or to the cat's eye itself. Typically, such cats' eyes have an overall depth not exceeding 18 mm.

Existing cats' eyes including LED flasher circuits have not been able to conform to this standard height and have therefore included a deeper housing adapted to be sunk into the road surface. For example, the Japanese company Kyocera manufacture a curb flasher under the name Accless having an outer casing whose height above ground is 28 mm but which has an extended casing for sinking below the ground surface having a depth of 133 mm. A pair of solar panels are mounted on an upper surface of the housing and are coupled to a circuit enclosed within the lower housing and including a pair of rechargeable batteries which are recharged by the solar panel during daylight and provide electrical power to the flasher circuit at night.

Clearly, such a cat's eye cannot easily replace existing, conventional cats' eyes on account of the effort required to sink the housing into the road surface which, particularly on long stretches of road, is a major undertaking.

Likewise, a flashing light for mounting on a curb is manufactured under the trade mark Swareflex including therein an LED solar-powered flasher and a storage battery for storing electrical energy transformed by a solar cell. The storage battery has a capacity of 14 days power consumption when fully charged. In order to become fully charged, fine weather (corresponding to intense ambient illumination) is required for a minimum of four days.

It would obviously be preferable to provide an LED flasher circuit within a standard cat's eye housing so as to provide the additional safety resulting from their improved visibility whilst nevertheless not requiring any major roadworks for their installation.

It is envisaged that such a miniaturized flasher circuit would also find application in memorial symbols such as are commonly fixed to gravestones, and the like. In this connection, U.S. Pat. No. 5,013,972 (Malkieli et al.) discloses a symbolic/religious memorial light having a flickering-candle appearance and operated either by a solar cell unit or by a rechargeable battery charged thereby.

The flasher circuit disclosed by Malkieli et al. is based on a conventional astable multivibrator, whilst the solar cell has a nominal current rating of only 18 mA. The rechargeable battery includes a couple of conventional nickel-cadmium cells, each having a nominal voltage of 1.25 V. In such an arrangement, the solar cell would not be able both to energize the flasher circuit and also maintain the rechargeable cells fully charged for extended periods of time in the absence of intense ambient light conditions.

SUMMARY OF THE INVENTION

It is an object of the invention to provide an electrical flasher circuit suitably dimensioned that it can fit within a standard cat's eye housing.

It is a further object of the invention to provide such an electrical flasher circuit which has improved operating characteristics over hitherto proposed flasher circuits, in particular by providing continuous illumination for a longer period of time from a fully charged battery and employing a battery recharging facility which achieves full charge in a very much lower period of time than has been achieved with hitherto proposed systems.

According to the invention there is provided an electrical flasher circuit, comprising:

- a rechargeable battery having a nominal voltage no greater than 1.2 V,
- a solar panel having a nominal current rating of 70 mA and a nominal voltage of 3.6 V coupled to the rechargeable battery,
- an oscillator circuit coupled to the rechargeable battery and to the solar panel having a nominal current drain under 0.5 mA and operative from a supply voltage in excess of 0.5 V for producing an output voltage which oscillates at a predetermined frequency, and
- at least one LED having a nominal drive current of 0.5 mA coupled to the oscillator circuit for flashing in response to the oscillating output voltage;
- whereby the solar panel provides sufficient power to energize the oscillator circuit and to recharge the rechargeable battery when at least a predetermined threshold of light acts on the solar panel, and the rechargeable battery alone energizes the oscillator circuit for at least a first predetermined time period in the absence of said light.

In accordance with a preferred embodiment of the invention, the oscillator circuit includes an integrated circuit which facilitates miniaturization, the circuit permitting the rechargeable battery to become fully charged in a time period of 2 hours and then to continue operating continuously for 18 days even in the absence of ambient illumination.

Whilst such an electrical flasher circuit has particular application as an auxiliary safety measure for use in cats' eyes, it also has application in memorial symbols for mounting on, or near, grave stones and the like so as to provide substantially perpetual illumination.

BRIEF DESCRIPTION OF THE DRAWINGS

For a clearer understanding of the invention and to see how the same may be carried out in practice, some preferred embodiments will now be described, by way of nonlimiting example only, with reference to the accompanying drawings, in which.

DETAILED DESCRIPTION OF PREFERRED EMBODIMENTS

Figure 1:
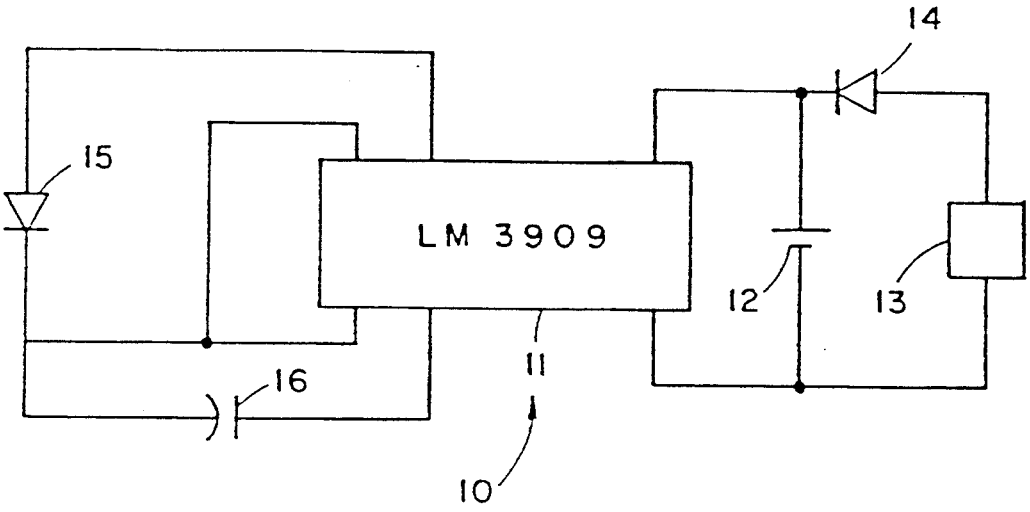
FIG. 1 shows schematically an electrical circuit diagram of a flasher circuit according to the invention.

Referring to FIG. 1 there is shown schematically a circuit diagram of an LED flasher circuit designated generally as 10. The flasher circuit 10 comprises an LM 3909 integrated LED flasher circuit 11 manufactured by National Semiconductor and having a nominal low voltage operation from just over 1 V to 6 V and a low current drain averaging under 0.5 mA. Connected to the integrated circuit 11, in accordance with the manufacturer's data specification, is a rechargeable battery 12 having a nominal voltage of 1.2 V and rated at 280 mAH. The rechargeable battery 12 is trickle charged by a solar panel 13 having a nominal voltage of 3.6 V and rated at 55 mA, via a rectifier diode 14 which prevents current flowing from the rechargeable battery 12 to the solar panel 13.

An output of the integrated circuit 11 is connected to a light emitting diode (LED) 15 in series with a 47 μF capacitor 16 whose value in combination with the internal circuitry of the integrated circuit 11 provides a flashing frequency of approximately 0.7 Hz.

The LED 15 is a GaAlAs (gallium aluminum arsenide) high brightness component such as manufactured by the Toshiba Company of Japan under the product code TLRA120. Such a device is operable from a drive current equal to 20 mA at a typical forward voltage of 1.8 V but can, in fact, operate at a drive current as low as 0.5 mA. This feature is exploited in the particular construction employed in the preferred embodiment so as to permit the lower operating range of the LM 3909 integrated circuit 11 to be reduced below the manufacturer's specification. This allows the circuit to operate even when the voltage of the rechargeable battery 12 falls to as low as 0.8 V, below which voltage the circuit stops operating so that the rechargeable battery 12 can never completely discharge.

The flashing circuit 10 has a current consumption of 1 mA hr at a voltage of 0.9 V such that if the voltage of the rechargeable battery 12 climbs to as little as 1.2 V, the rechargeable battery 12 has enough residual charge to energize the integrated circuit 11 on its own in the absence of sufficient ambient daylight.

However, even in moderate ambient daylight such that the solar panel 13 provides a voltage exceeding 1.2 V, the rechargeable battery 12 does not participate in energizing the integrated circuit 11 and is maintained fully charged by the solar panel 13.

On an average light intensity equivalent to 20 mA hr, the rechargeable battery 12 is rapidly recharged, achieving full charge within a time period of 2 hours and then has enough residual charge to permit continuous operation of the flashing circuit 10 for up to 20 days.

It should be noted that whilst only one LED 15 is shown in FIG. 1, up to four LEDs may be connected in parallel without derogating from the operating characteristics as described.

It should also be noted that, by adjusting the value of the capacitor 16, the oscillation frequency of the LED 15 may be raised above the critical frequency of fusion (approximately 25 Hz), so that any flicker of the LED 15 is undetectable by the human eye.

Figure 2:
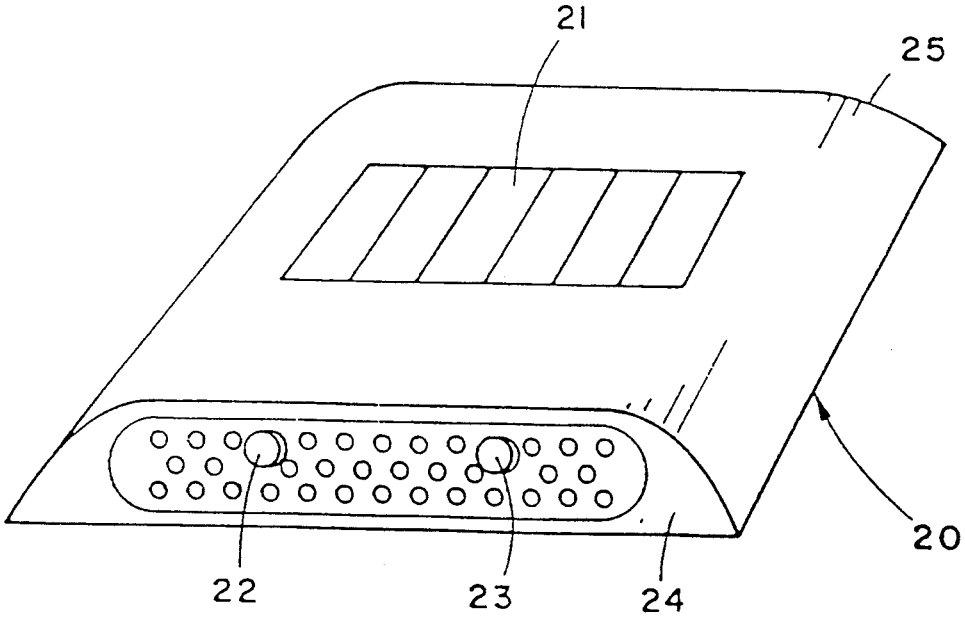
Fig. 2 PRIOR ART
FIG. 2 shows a cat's eye having mounted therein the flasher circuit shown in FIG. 1.

FIG. 2 shows a conventional type of cat's eye including a housing 20 containing therein the flasher circuit 10 described above with reference to FIG. 1 of the drawings. A solar panel 21 is mounted on an upper surface of the housing 20, a pair of LEDs 22 and 23 being provided on each of two opposing reflecting side walls 24 and 25 of the housing 20.

During daylight hours, the solar panel 21 recharges an internal storage battery such that in the presence of sufficient ambient illumination, the solar panel 21 is alone responsible for providing power to the flasher circuit 10 (FIG. 1), any residual solar energy being used to trickle charge the rechargeable battery 12 and maintain it fully charged.

Under these conditions, the LEDs 22 and 23 flash continuously so as to provide a visual warning to motorists and thus enhanced safety.

The solar panel 21 is mounted within a small recess in the upper surface of the housing 20 so as not to protrude above the upper surface of the housing 20. This prevents damage to the solar panel 21 in the event that a vehicle's wheels mount the cat's eye.

The overall height of the housing 20 protruding above a road surface is nominally 18 mm and the housing 20 is, in all respects, identical to that currently employed in standard cats' eyes.

Figure 3:
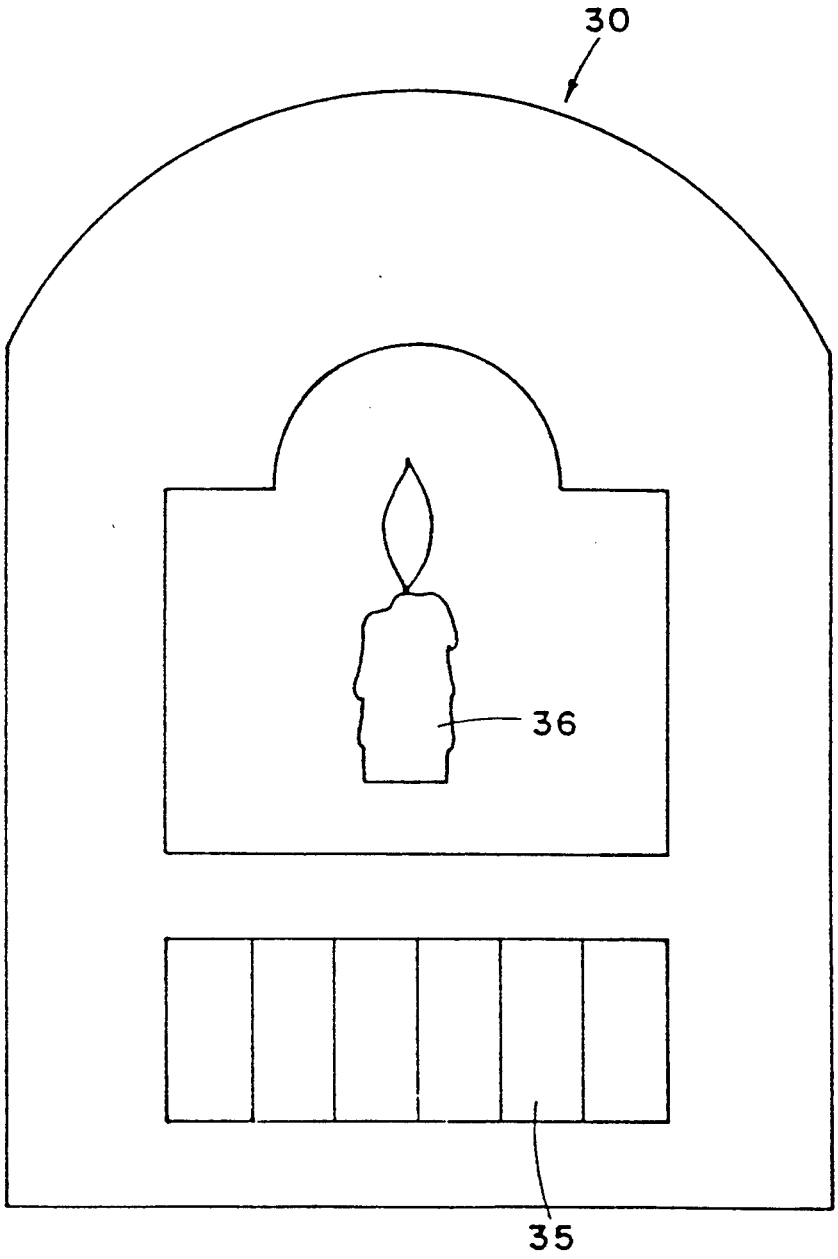
FIG. 3 shows a first memorial symbol including therein the flasher circuit shown in FIG. 1.
Figure 5:
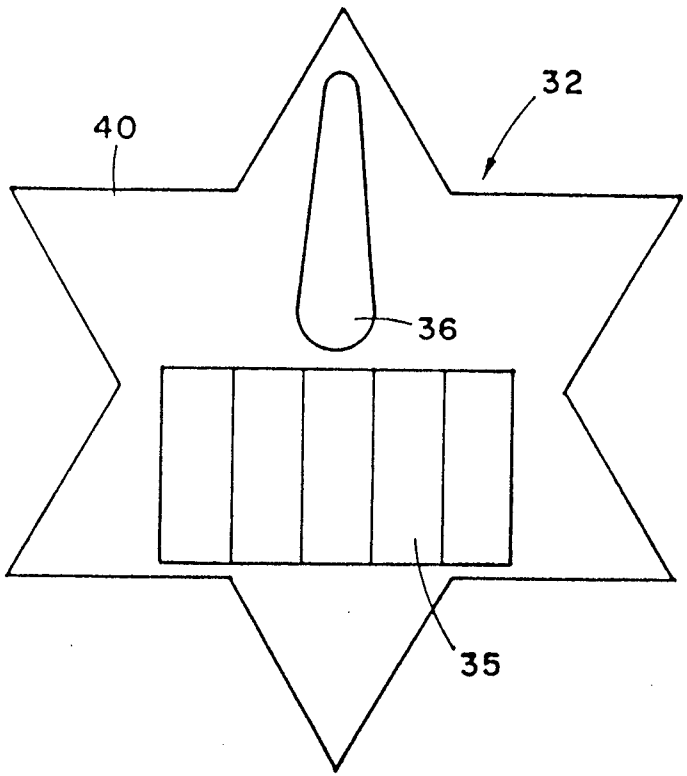
FIG. 5 shows a third memorial symbol including therein the flasher circuit shown in FIG. 1.
Figure 4:
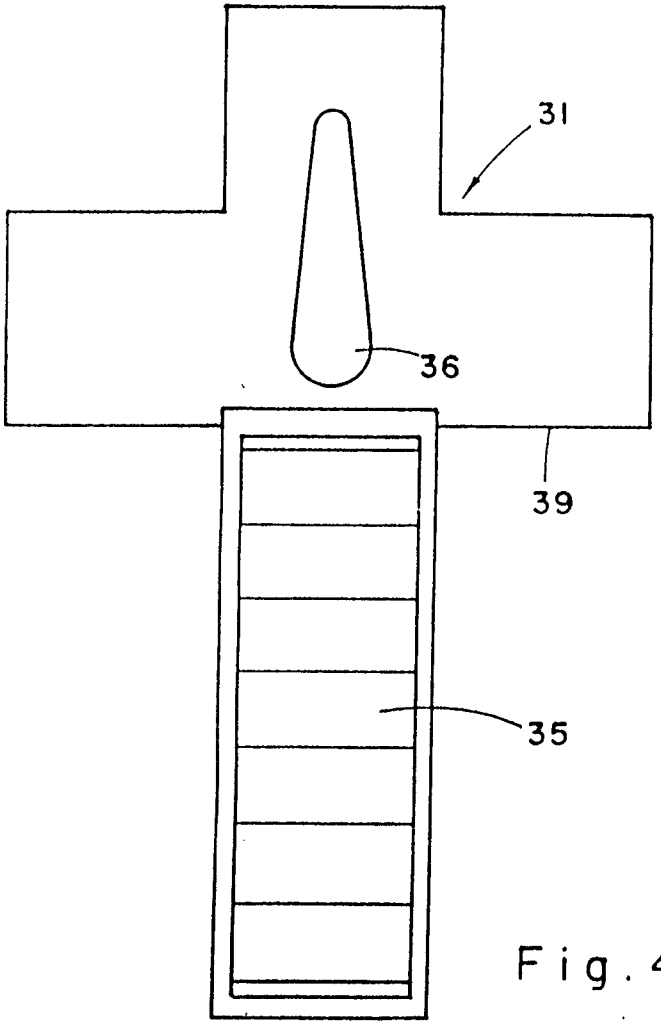
FIG. 4 shows a second memorial symbol including therein the flasher circuit shown in FIG. 1.

Referring now to FIGS. 3 to 5 there are shown various forms of memorial symbols including therein the flasher circuit 10 shown schematically in FIG. 1.

Each of the memorial symbols depicted generally as 30, 31 and 32 is formed from a plastics moulding and includes a solar panel 35 in a front surface thereof as well as a substantially candle-shaped window 36 behind which the LED 15 of the flasher circuit 10 (shown in FIG. 1) is mounted.

The memorial symbol 30 shown in FIG. 3 is particularly adapted to be fixed to a grave stone, the rear part of its housing being so shaped as to be accommodated within a recess in the grave stone and fixed therein with a suitable adhesive. On account of the operating characteristics of the flasher circuit 10, maintenance-free operation is assured for a long period of time.

The memorial symbol 31 shown in FIG. 4 has a crucifix shaped housing 39 whilst the memorial symbol 32 shown in FIG. 5 has a housing 40 in the shape of a Star of David. For these memorial symbols, it is preferred that the flasher circuit operate above about 25 Hz so that the light will appear constant to an observer.

In all cases, the housing may be of slim-line construction owing to the miniature dimensions of the flasher circuit 10 shown in FIG. 1.

What is claimed is:

1. An electrical flasher circuit, comprising:

a rechargeable battery having a nominal voltage no greater than 1.2 V, a solar panel having a nominal current rating of about 70 mA and a nominal voltage of about 3.6 V coupled to the rechargeable battery, an oscillator circuit coupled to the rechargeable battery and to the solar panel having a nominal current drain under 0.5 mA and operative from a supply voltage in the range of about 0.8 V to at least said nominal voltage of said solar panel for producing an output voltage which oscillates at a predetermined frequency, and at least one LED having a nominal drive current of about 0.5 mA coupled to the oscillator circuit for flashing in response to the oscillating output voltage;

whereby the solar panel provides sufficient power to energize the oscillator circuit and to recharge the rechargeable battery when at least a predetermined threshold of light acts on the solar panel, and the rechargeable battery alone energizes the oscillator circuit for at least a first predetermined time period in the absence of said light.

2. The flasher circuit according to claim 1, including up to four LEDs.

3. The flasher circuit according to claim 1, wherein the solar panel substantially completely recharges the rechargeable battery when light acts on the solar panel for at least a second predetermined time period.

4. The flasher circuit according to claim 1, wherein said first predetermined time period is 18 days when the rechargeable battery is substantially fully charged.

5. The flasher circuit according to claim 3, wherein the second predetermined time period is 2 hours.

6. The flasher circuit according to claim 1, wherein the oscillator circuit includes a LM 3909 integrated circuit.

7. The flasher circuit according to claim 1, wherein said predetermined frequency is greater than the critical frequency of fusion.

8. A cat's eye for reflecting a vehicle's headlamps, the cat's eye comprising:

a housing having a depth no greater than 18 mm, an electrical flasher circuit within the housing, comprising:

a rechargeable battery having a nominal voltage no greater than 1.2 V, a solar panel having a nominal current rating of about 70 mA and a nominal voltage of about 3.6 V coupled to the rechargeable battery, an oscillator circuit coupled to the rechargeable battery and to the solar panel having a nominal current drain under 0.5 mA and operative from a supply voltage in the range of about 0.8 V to at least said nominal voltage of said solar panel for producing an output voltage which oscillates at a predetermined frequency, and at least one LED having a nominal drive current of about 0.5 mA coupled to the oscillator circuit for flashing in response to the oscillating output voltage;

whereby the solar panel provides sufficient power to energize the oscillator circuit and to recharge the rechargeable battery when at least a predetermined threshold of light acts on the solar panel, and the rechargeable battery alone energizes the oscillator circuit for at least a first predetermined time period in the absence of said light.

9. The cat's eye according to claim 8, wherein the solar panel is fixed to an upper surface of the housing.

10. The cat's eye according to claim 8, wherein at least one LED is provided on respective opposing sides of said housing.

11. The cat's eye according to claim 8, wherein the flasher circuit includes up to four LEDs.

12. The cat's eye according to claim 8, wherein the solar panel substantially completely recharges the rechargeable battery when light acts on the solar panel for at least a second predetermined time period.

13. The cat's eye according to claim 8, wherein said first predetermined time period is about 18 days when the rechargeable battery is substantially fully charged.

14. The cat's eye according to claim 12, wherein the second predetermined time period is about 2 hours.

15. The cat's eye according to claim 8, wherein the oscillator circuit includes a LM 3909 integrated circuit.

16. The cat's eye according to claim 8, wherein said predetermined frequency is greater than the critical frequency of fusion.

17. A memorial symbol, comprising:

a housing containing therein the flasher circuit in accordance with claim 1.

18. The memorial symbol according to claim 17, wherein the housing includes a candle-shaped window for displaying said flashing LED.

19. The memorial symbol according to claim 17, wherein the housing has a substantially crucifix shape.

* * * * *